United States Patent [19]

Bowman et al.

[11] Patent Number: 4,464,835

[45] Date of Patent: Aug. 14, 1984

[54] DISPOSABLE RAZOR

[75] Inventors: Peter Bowman, Sandy Hook, Conn.; Allan S. Frieze, Salt Lake City, Utah

[73] Assignee: Warner-Lambert Company, Morris Plains, N.J.

[21] Appl. No.: 400,558

[22] Filed: Jul. 21, 1982

[51] Int. Cl.[3] ..... B26B 21/06

[52] U.S. Cl. ..... 30/84

[58] Field of Search ..... 30/84, 79, 32, 66, 67, 30/47

[56] References Cited

U.S. PATENT DOCUMENTS

| | | | |
|---|---|---|---|
| 974,906 | 11/1910 | Monetti | 30/79 |
| 2,744,319 | 5/1956 | Cutler | 30/84 X |
| 2,768,436 | 10/1956 | Randol | 30/67 X |
| 4,328,615 | 5/1982 | Bowman et al. | 30/32 |
| 4,395,822 | 8/1983 | Ciaffone | 30/79 |
| 4,425,705 | 1/1984 | Chen | 30/84 |

*Primary Examiner*—Jimmy C. Peters

*Attorney, Agent, or Firm*—R. S. Strickler

[57] ABSTRACT

A disposable razor including a blade cover and a blade support, said cover making a permanent interlocking connection with the blade support while being movable to and fro relative to the blade support from a storage position to a shaving position having structure for (1) blocking inadvertent movement of the cover out of the storage position and (2) enhancing the integrity of the interlocking connection.

2 Claims, 6 Drawing Figures

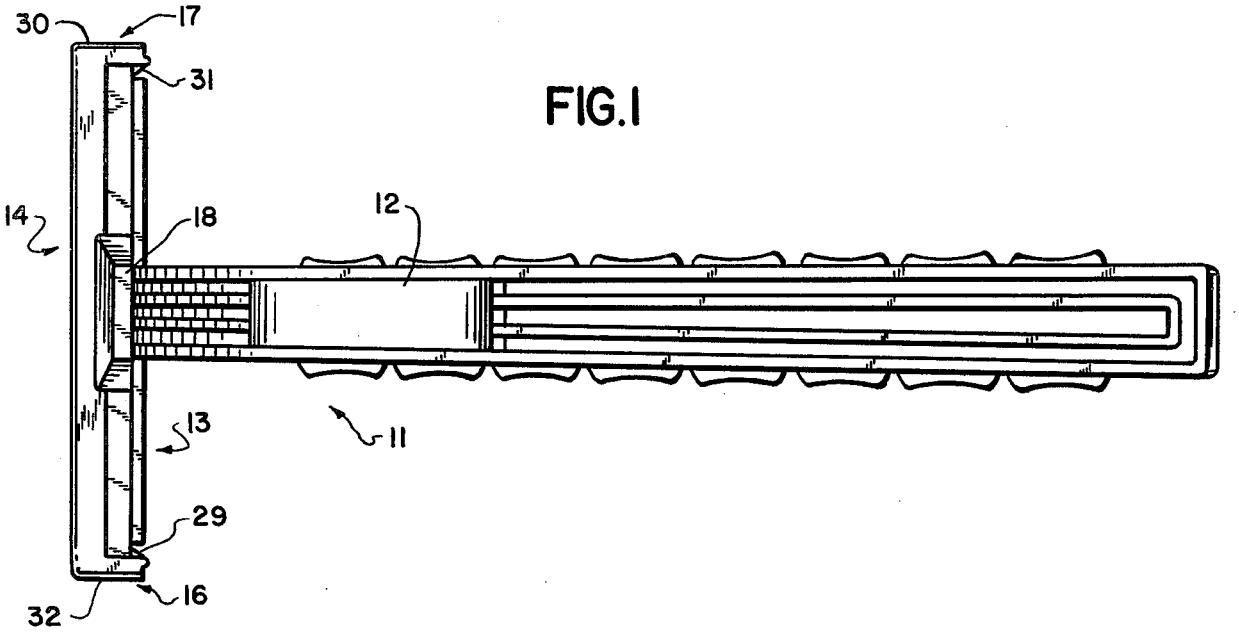
FIG.1
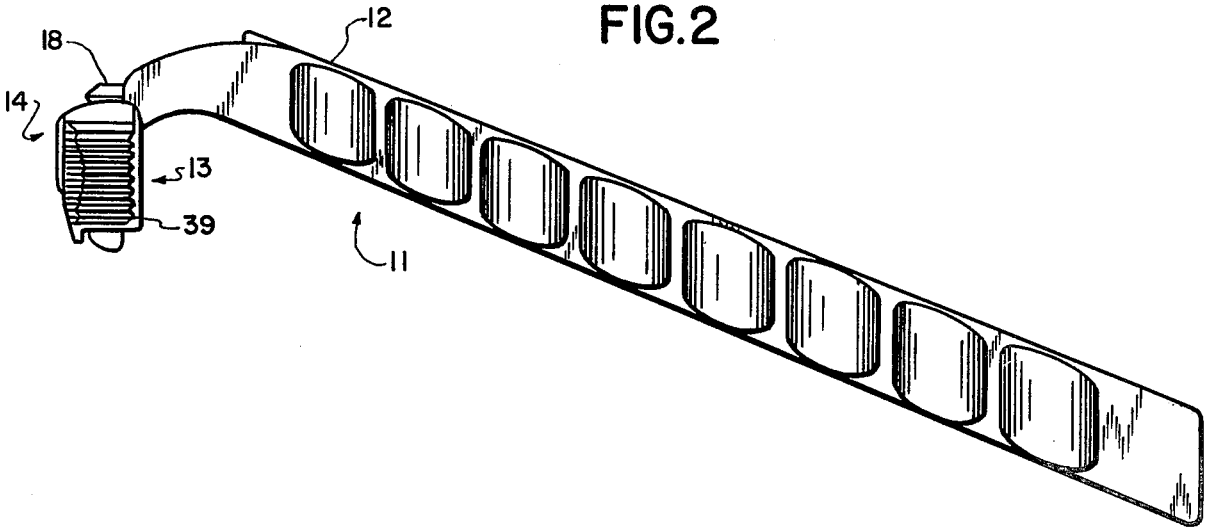
FIG.2
FIG.3
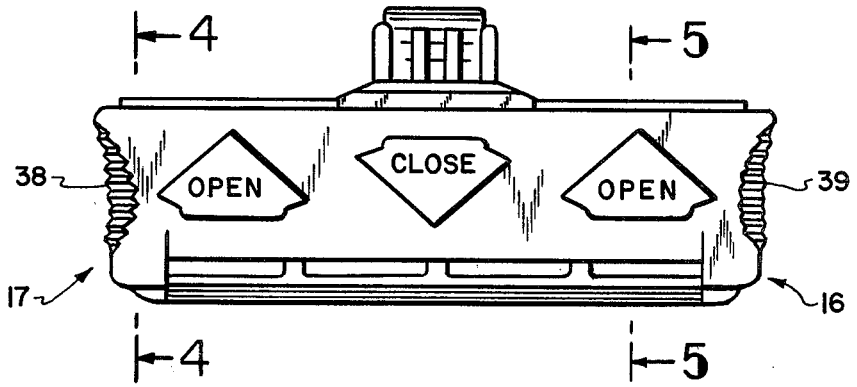

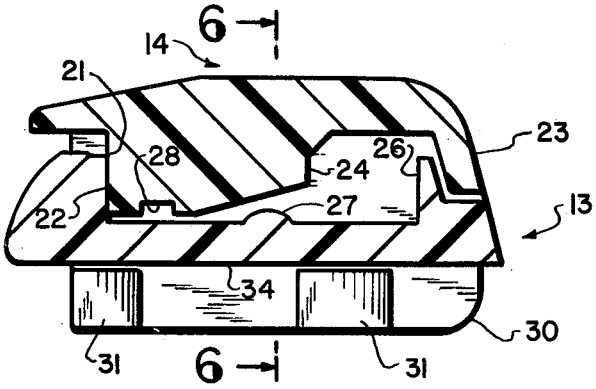
FIG.4
FIG.5
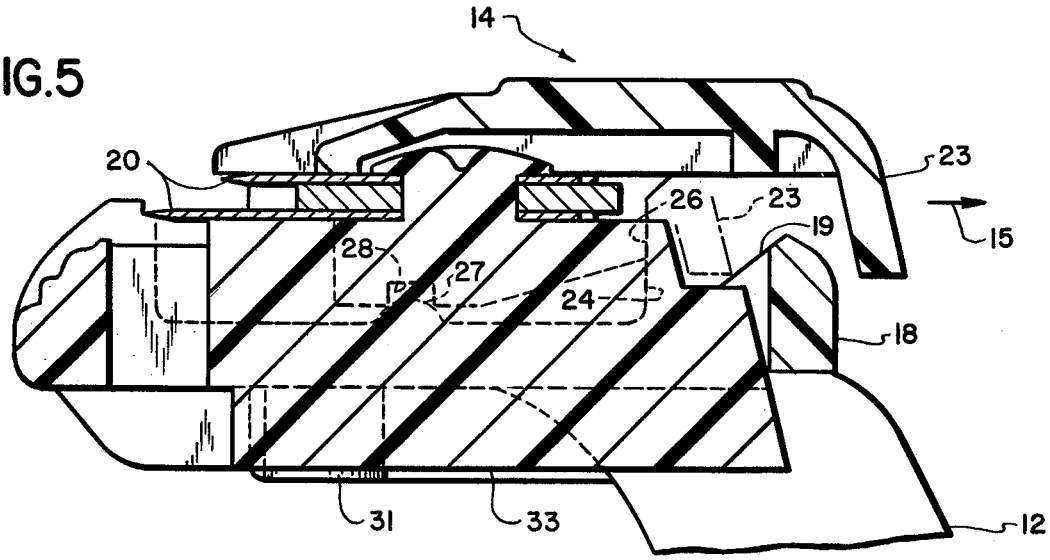
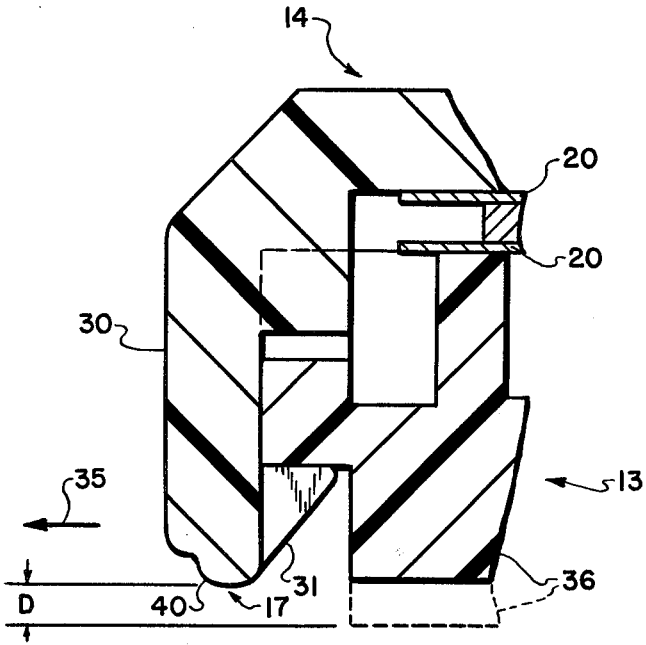
FIG.6

DISPOSABLE RAZOR

BACKGROUND OF THE INVENTION

The present invention relates to razors and relates in particular to disposable razors which, except for the blade package, are fabricated of moldable plastic.

The language "blade package", "blade" or "blades" is intended to denote one or more single edge blades appropriately separated by a spacer or spacer means when more than one blade is used.

More particularly, the invention relates to disposable razors for wet shaving of the type fitted with a movable or slidable cover or cap which serves dually as (1) a means for ensuring proper blade edge exposure or proper blade geometry during shaving and (2) a protective device for perserving the integrity of the blade edge during storage.

A typical razor of this class is disclosed and described in U.S. Pat. No. 4,328,615 issued on May 11, 1982, to Bowman et al. and in a co-pending application, Ser. No. 359,341 filed Mar. 18, 1982, also by Bowman et al.

It is a particular feature of the present invention to provide an improved disposable razor with a sliding cap.

At the time of manufacture and during first shipment into commerce, the sliding cap is in the storage or first position with the blade edge protected.

The present invention relates to structure which operates to prevent inadvertent movement of the cap caused by usual and customary jostling during transport from the point of manufacture to the point of sale.

Stated differently, the present invention relates to structure which preserves the integrity of the storage position of the cap during transit in commerce.

SUMMARY OF THE INVENTION

A particular feature of the invention is the provision of an exterior ramp-like stop means which cooperates with the cap to retain the cap in the storage position during transit where the stop means and the cap are responsive to manual manipulation to override the stop means when it is desired to move the cap from the storage position to the shaving or second position.

The cap is interlocked with the body or blade support of the razor in a fashion described in detail in said co-pending application.

It is a still further feature of the present invention to provide structure which enhances the integrity of interlocking means to preclude inadvertent unlocking of the cap from the razor body or blade support.

A razor embracing certain features of the invention may comprise a razor having at least one blade with a single cutting edge carried by a support or a razor body with a permanently attached cover or cap interlocking the body and movable manually to and fro from a first or storage position to a second position in which the cutting edge is exposed properly for wet shaving and exterior stop means on the razor cooperating with the cap or blocking inadvertent movement of the cap during transit in commerce.

A razor embracing certain other features of the invention includes structure for enhancing the integrity of the permanent interlocking connection between the cap and the razor body.

Other features and advantages of the present invention will become more apparent from an examination of the succeeding specification when read in conjunction with the appended drawings, in which;

BRIEF DESCRIPTION OF THE DRAWINGS

FIG. 1 is a rear view of a disposable razor embracing the invention;

FIG. 2 is a side views of FIG. 1;

FIG. 3 is a top view of the razor of FIG. 1;

FIG. 4 is a sectional view of FIG. 3 in the plane of the line 4—4 as viewed in the direction of the arrows;

FIG. 5 is a sectional view of FIG. 3 in the plane of line 5—5 as viewed in the direction of the arrows; and FIG. 6 is a sectional view of FIG. 4 in the plane of line 6—6 as viewed in the direction of the arrows.

DESCRIPTION OF PREFERRED EMBODIMENTS

Referring now in detail to the drawings, the reference numeral 11 designates a disposable razor having a handle 12, a body or blade support 13, a movable cover or cap 14 interlocking the body 13 at opposed ends 16 and 17 of the body (see FIGS. 1 and 6).

The upper end of the handle 12 is formed with a stop means defining a centrally disposed lug 18 having a ramp 19.

FIG. 4 shows the cover 14 in the closed or storage position with the wall 21 of the cover in face-to-face abutment with the mating wall 22 of the razor body 13.

A reference to FIG. 5 shows (in dotted lines) the cooperation between the cover 14 and the stop means in the storage position in that a skirt 23 of the cover is bearing upon ramp 19 of lug 18. A horizontal component of force is generated by this relationship of piece parts sufficient to overcome an opposing force generated during the jostle of transit in commerce tending to move the cover away from the storage position.

When the cover 14 is moved in the direction of arrow 15 to the second position (solid line position of FIG. 5), the skirt 23 climbs the ramp 19 and overrides the lug 18 exposing the blade edges 20 properly for shaving.

In this position, wall 24 of cover 14 abuts mating wall 26 of razor body to ensure precise blade geometry.

Note that frictional cooperation between button 27 and cut-out 28 acts to hold the cover in the correct position during shaving.

FIG. 1, 4 and 6 show opposed pairs of claws 29 and 31 which project inwardly from flexible sidewalls 30 and 32 of the cover 14 operative to effect an interlocking and sliding connection with rails 33 and 34 formed on opposed sides of razor body or blade support 13 as is most apparent in FIGS. 4 and 6.

On occasion, a force inadvertently applied to a pair of adjacent claws 29 or 31 tending to push the claws outwardly as shown by the arrow 35 of FIG. 6, will flex the associated sidewall outwardly causing a pair of claws to slide outwardly and off their mating rail with the result that the interlock between the cover 14 and the razor body 13 is broken.

To minimize the happening of this occurrence and to enhance the integrity of the interlock between the cover and the razor body, a pad 36 is formed integral with the razor body. Any force tending to slide the claws 29 or 31 off the mating rails 33 or 34 is minimized in direct proportion to the extent to which the pad 36 projects below the bottom margin 40 of the sidewall such as sidewall 30 in FIG. 6.

For example, if the pad 36 is thickened as shown in dotted lines in FIG. 6 and thus projects an appreciable distance D below margin 40, there is a proportionally less likelihood that any instrumentality can contact a pair of claws 31 to exert a force tending to slide claws 31 off mating track 33.

In operation, the cover 14 is moved from the storage position (dotted line position of skirt 23 in FIG. 5) to the shaving position (solid line position of FIG. 5) by manually grasping the cover 14 at the serrated indentations 38 and 39 shown in FIG. 3.

As stated previously, during this motion, skirt 23 rides up ramp 19 and overrides lug 18 until wall 24 abuts mating wall 26, thus establishing the correct blade exposure or blade geometry.

In returning the cover to the storage position, the cover is again grasped manually at serrations 38 and 39 and pushed in the reverse direction. Upon this occurrence, the skirt 23 and cover 14 flex (by virtue of the inherent resilience of the plastic) to override the lug 18, and motion continues until wall 21 fetches up against mating wall 22 to establish the storage position with skirt 23 bearing upon ramp 19 as shown in dotted lines in FIG. 5.

What is claimed is:

1. In a disposable substantially plastic razor having at least one cutting edge of the type having a permanently attached cover making an interlocking connection with the razor body and manually movable to and fro from a first position in which the edge is protected to a second position in which the edge is exposed properly for wet shaving, the improvement comprising:

an exterior stop means on the razor for retaining the cover in the first position to prevent inadvertent movement of the cover during transit in commerce, said stop means defining a lug having a ramp cooperates with a skirt portion of the cover to retain the cover releasably in said first position, said lug being disposed in a medial position relative to the razor body and relative to the cover.

2. In a disposable substantially plastic razor having at least one cutting edge of the type having a permanently attached cover making an interlocking connection with the razor body and manually movable to and fro from a first position in which the edge is protected to a second position in which the edge is exposed properly for wet shaving, the improvement comprising:

an exterior stop means on the razor for retaining the cover in the first position to prevent inadvertent movement of the cover during transit commerce, and a pad formed integrally with the razor body and defining a projection extending beyond the region of said interlocking connection effective to minimize if not preclude the application of force along a line of action tending to break said interlocking connection.

* * * * *